United States Patent [19]

Tamaki

[11] Patent Number: 4,970,928

[45] Date of Patent: Nov. 20, 1990

[54] HAMMERING OPERATION CONTROL UNIT OF PIANO ACCOMPANIED WITH AUTOMATIC PERFORMANCE FUNCTION

[75] Inventor: Takashi Tamaki, Hamamatsu, Japan

[73] Assignee: Yamaha Corporation, Hamamatsu, Japan

[21] Appl. No.: 501,672

[22] Filed: Mar. 29, 1990

[30] Foreign Application Priority Data

Mar. 30, 1989 [JP] Japan ..... 1-80635

[51] Int. Cl.[5] ..... G10F 1/02; G10G 3/04

[52] U.S. Cl. ..... 84/21; 84/115; 84/DIG. 7; 84/462

[58] Field of Search ..... 84/13, 17, 18, 19, 20, 84/21, 22, 23, 115, 462, DIG. 7

[56] References Cited

U.S. PATENT DOCUMENTS 1,979,633 11/1934 Miessner ..... 84/21

4,913,026 4/1990 Kaneko et al. ..... 84/21

*Primary Examiner*—Brian W. Brown

*Attorney, Agent, or Firm*—Spensley, Horn, Jubas & Lubitz

[57] ABSTRACT

In order to eliminate the disadvantages due to varieties of a string-striking speed (i.e., dynamic characteristic) of a hammer, a hammering operation control unit is applied to a piano accompanied with an automatic performance function which can reproduce a musical performance recording in advance. Based on a detected string-striking speed of the hammer which is driven by the reference drive value predetermined to each key, the hammering operation control unit computes a deviation from the target string-striking speed corresponding to the reference drive value as a compensation value. Then, the newest computed compensation value is stored in a memory device or medium such as a floppy disk by periodically renewing the stored compensation value. Based on the stored compensation value, the string-striking speed of the hammer is to be compensated.

2 Claims, 4 Drawing Sheets

HAMMERING OPERATION CONTROL UNIT OF PIANO ACCOMPANIED WITH AUTOMATIC PERFORMANCE FUNCTION

BACKGROUND OF THE INVENTION

1. Field of the Invention

The present invention relates to a hammering operation control unit of a piano accompanied with an automatic performance function, in which varieties of dynamic characteristics among plural keys are adjusted by controlling a drive value of each key, thereby achieving an accurate playback of musical performance.

2. Prior Art

The conventional piano accompanied with the automatic performance function (hereinafter, referred to as "automatic performance piano") is constructed such that a key actuating unit is installed in an acoustic piano (i.e., non-electronic piano), wherein this key actuating unit has plural solenoids (e.g., eighty-eight solenoids) of which number corresponds to the number of keys.

The above-mentioned key actuating unit is controlled by a controller constructed by a micro computer and the like. More specifically, by supplying certain current pattern (i.e., pulse pattern) to all of the solenoids of which number is equal to that of the keys, plungers are projected at constant velocity so that the keys are driven and strings are struck. In this case, the controller sequentially operates desirable keys in accordance with the musical tune to be performed.

However, the above-mentioned conventional automatic performance piano cannot eliminate the varieties of dynamic characteristics of the keys which are different in each piano. For example, the conventional piano cannot eliminate the variety of hammering force to be caused when the key is depressed in each piano. In addition, the conventional piano cannot eliminate the variety of dynamic characteristic which is different in each key of the same piano. For example, the conventional piano cannot eliminate such variety to be occurred when a hammering action of one key is relatively heavy and different from that of another key. In other words, the conventional key driving unit cannot compensate the dynamic characteristic of each key by controlling its drive value. Because, the conventional key driving unit simply increases or decreases currents flown through solenoid coils. As a result, there is a problem in that the conventional piano cannot set operating states of both of normally functioned keys and malfunctioned keys at the optimum states.

SUMMARY OF THE INVENTION

It is accordingly a primary object of the present invention to provide a hammering operation control unit of the automatic performance piano, capable of adjusting the dynamic characteristic of each key independently.

In a first aspect of the present invention, there is provided a hammering operation control unit of the automatic performance piano comprising:

(a) key actuating means provided with respect to each of a plurality of keys of a keyboard of the piano for actuating each key;

(b) driving means for driving the key actuating means so that each key is driven by a reference drive value predetermined to each key;

(c) string-striking speed detecting means for detecting a string-striking speed of a hammer which strikes a string;

(d) compensation value computing means for computing a deviation of a detected string-striking speed from a target string-striking speed corresponding to the reference drive value as a compensation value;

(e) memory means for storing the compensation value by each key; and (f) renewing means for renewing storing contents of the memory means so that the newest compensation value computed by the compensation value computing means is to be stored in the memory means, whereby the string-striking speed and a dynamic characteristic of the hammer are compensated by the compensation value stored in the memory means.

In a second aspect of the present invention, there is provided a method of controlling a hammering operation of the automatic performance piano comprising steps of:

detecting a string-striking speed of a hammer which is driven by a reference drive value predetermined to each key, computing a deviation of a detected string-striking speed from a target string-striking speed corresponding to the reference drive value as a compensation value, storing the newest compensation value, and compensating the string-striking speed of the hammer based on a stored compensation value with respect to each key.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

Figure 1:
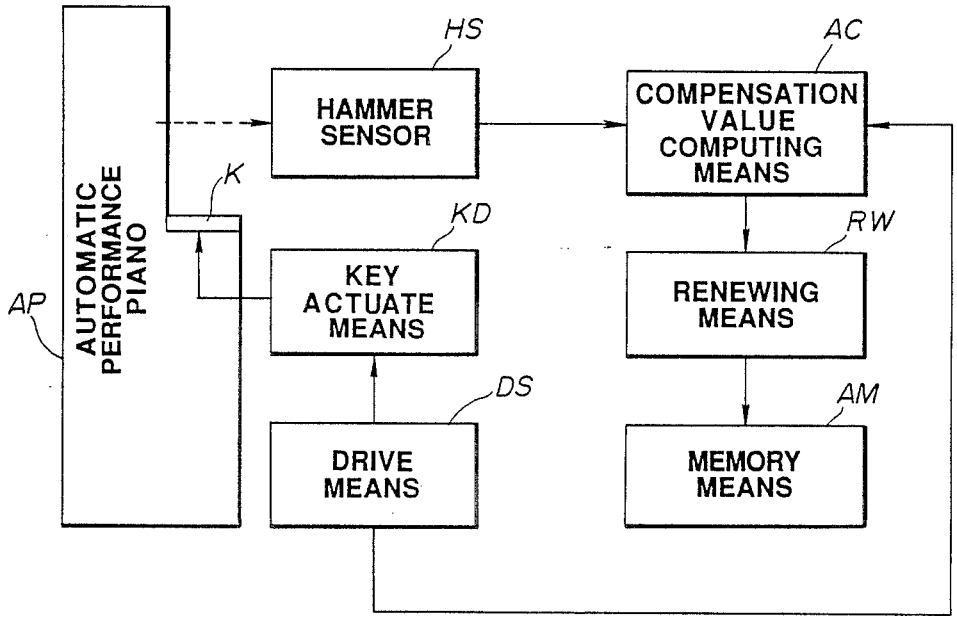
FIG. 1 is a block diagram showing a diagrammatical configuration of the electronic piano system as a whole.

Next, description will be given with respect to an embodiment of the present invention by referring to the drawings.

[A] ELECTRONIC PIANO SYSTEM

First, description will be given to the configuration and operation of the electronic piano system to which the hammering operation control unit according to the present invention can be applied.

In FIG. 1, the electronic piano system provides an automatic performance piano AP, a hammer sensor HS, key actuate means KD, drive means DS, compensation value computing means AC, renewing means RW and memory means AM. The key actuate means KD is provided to each key K of the automatic performance piano AP to thereby actuate each key K. The drive means drives the key actuate means KD to thereby actuate each key by the reference drive value which is predetermined to each key. The hammer sensor HS detects a string-striking speed of the hammer. Then, the compensation value computing means AC computes the deviation of the detected string-striking speed from the target string-striking speed corresponding to the above-mentioned reference drive value as a compensation value. The memory means AM stores the computed compensation value by each key. Under operation of the renewing means RW, the memory means AM stores the newest compensation value.

The above-mentioned key actuate means KD is designed to actuate each key by a command signal from a controller (not shown in FIG. 1). Under operation of the drive means DS, each key is driven by the reference drive value. Then, the hammer sensor HS detects the string-striking speed of each hammer. Based on the reference drive value and detected string-striking speed of each hammer, the compensation value computing means AC computes the deviation of the detected string-striking speed from the target string-striking speed corresponding to the reference drive value as the compensation value, which is to be stored in the memory means AM. Such compensation value is renewed by the newest value by the renewing means RW.

[B] EMBODIMENT

Next, description will be given with respect to an embodiment of the present invention by referring to FIGS. 2 to 4.

(1) Configuration of Embodiment

Figure 2:
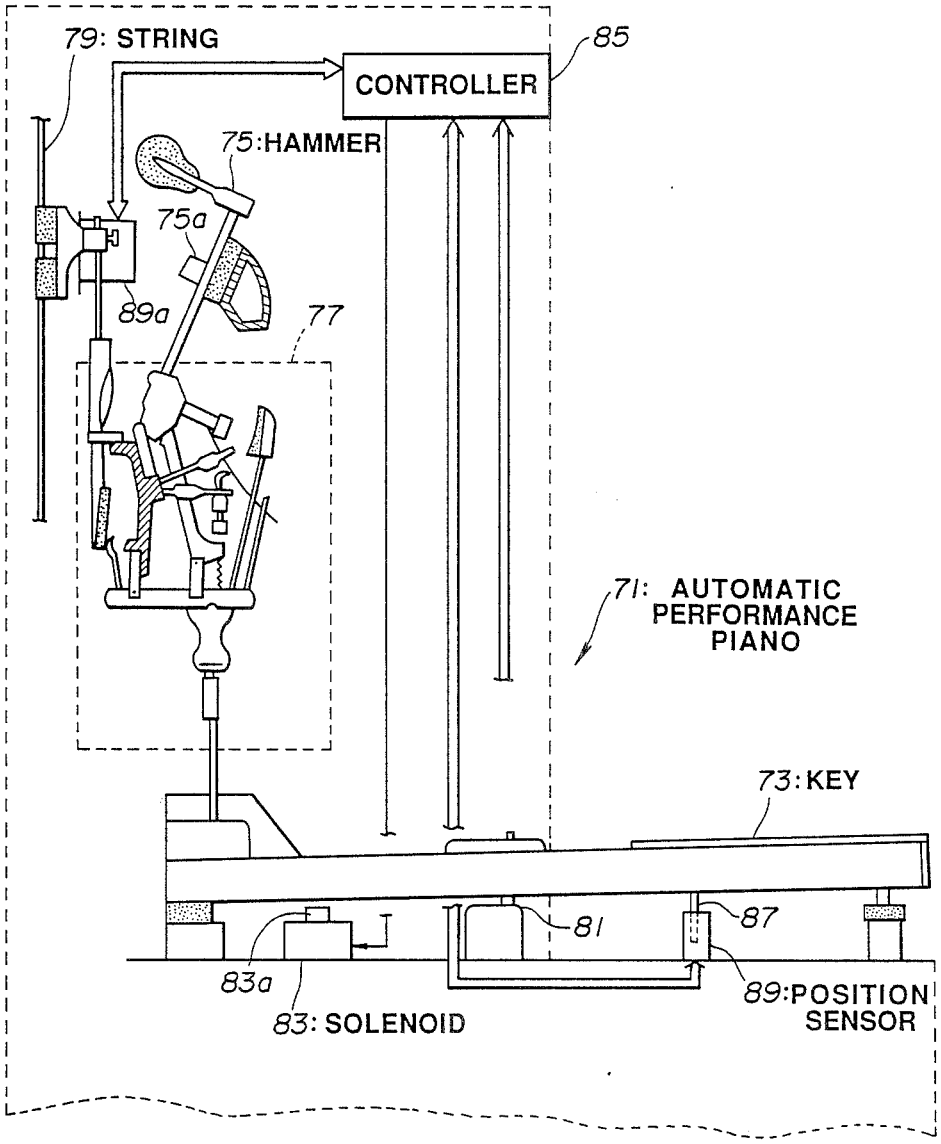
FIG. 2 is a side sectional view showing a mechanical construction of the automatic performance piano.

FIG. 2 is a side sectional view showing a mechanical construction of the automatic performance piano. In FIG. 2, the automatic performance piano 71 provides a keyboard including plural keys, e.g., eighty-eight keys each represented by numeral 73. In addition, this piano 71 also provides plural action mechanisms 77, plural hammers 75 and plural strings 79, wherein the motion of each key 73 is transmitted to each hammer 75 by each action mechanism 77 so that each string is to be struck by each hammer 75. Further, this piano 71 provides pedal mechanisms (not shown) and pedal solenoids (see numeral 80 in FIG. 3), wherein pedal solenoids drives pedal mechanisms.

The key 73 can be moved freely in upward and downward directions by a balance pin 81. When the performer depressed the edge portion of the key 73 or when a plunger 83*a* is projected from a solenoid 83 so that the key 73 is pressed upward by this plunger 83*a*, the action mechanism 77 operates in connection with such key operation so that the hammer 75 strikes the string 79.

Figure 3:
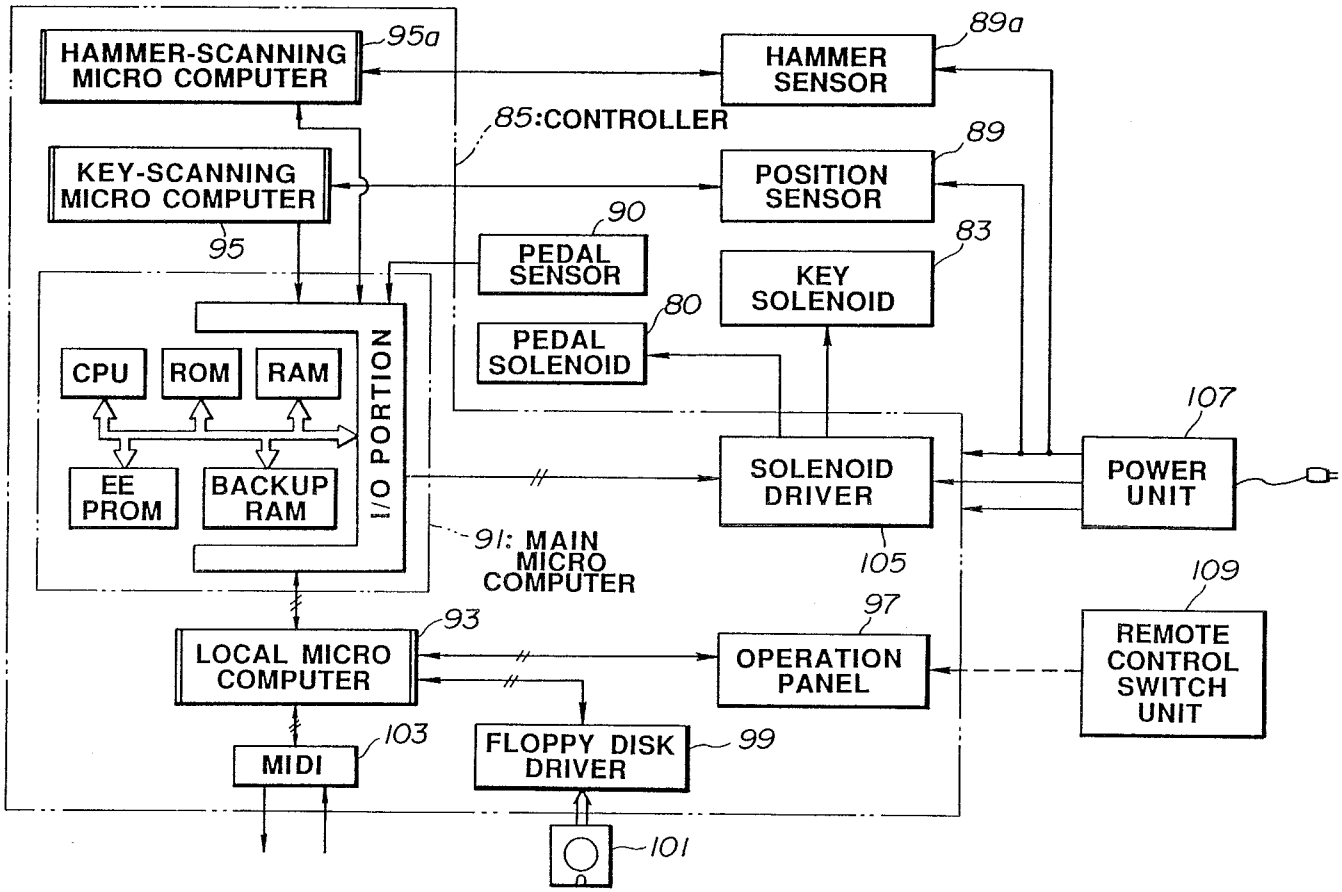
FIG. 3 is a block diagram showing a detailed electric configuration of the hammering operation control unit according to an embodiment and its peripheral circuits.
Figure 4:
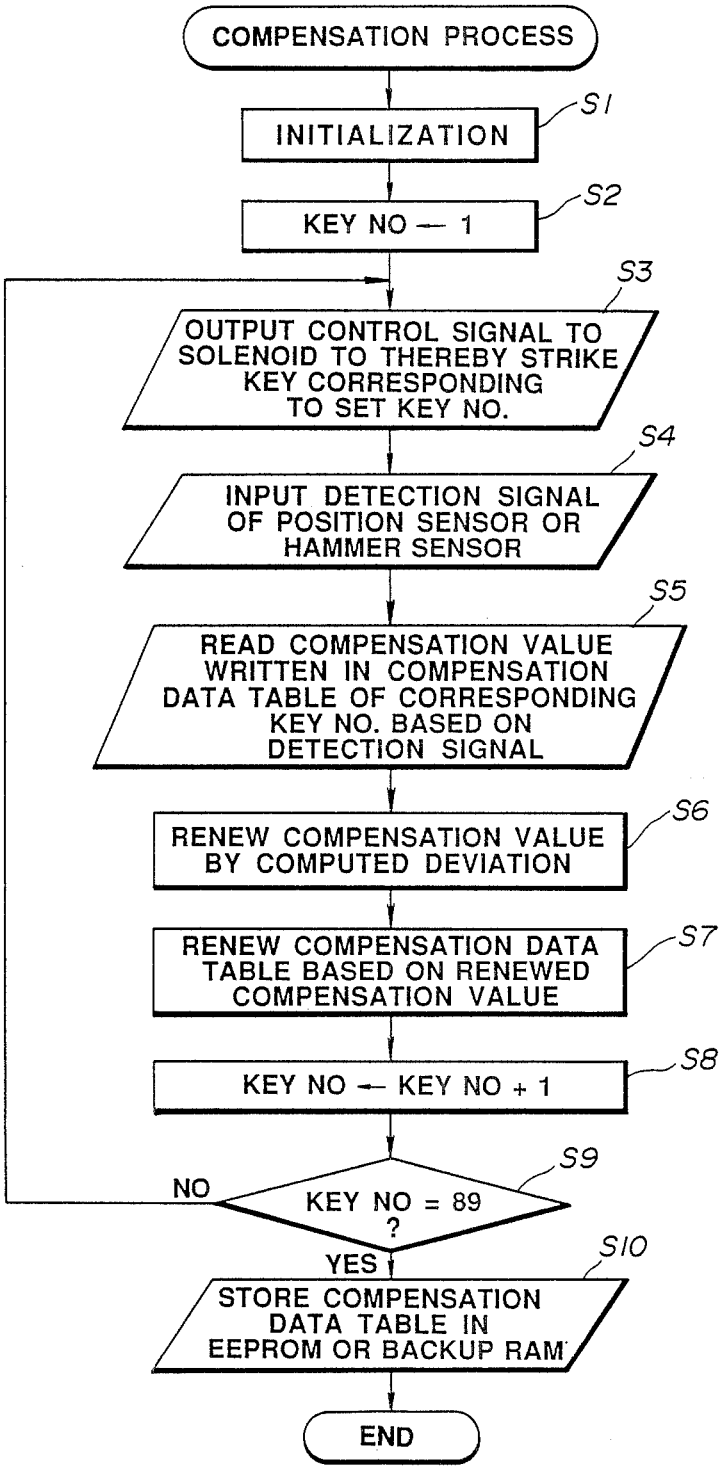
FIG. 4 is a flowchart showing an operation of a main micro computer shown in FIG. 3.

The automatic performance piano 71 shown in FIG. 2 further provides a controller 85, a position sensor 89, a hammer sensor 89*a* and a pedal sensor 90 (see FIG. 3). The position sensor 89 detects whether or not a shutter 87 fixed at a lower surface of the key 73 is passed through its sensing points. The hammer sensor 89*a* detects whether or not a shutter 75*a* fixed at a hammer shank is passed through its sensing points. The pedal sensor 90 detects whether or not the pedal mechanism is operated.

The position sensor 89 is constructed by one pair of photo-interrupters having plural sensing points which are disposed along a moving trace of the shutter 87. The hammer sensor 89*a* is also constructed by the similar photo-interrupters.

The position sensor 89 has four sensing points, wherein light of first sensing point is shut just after the key 73 is moved, and light of fourth sensing point is shut when the key 73 is depressed and hammer is moved to the position where the hammer almost strikes the string.

The controller 85 functions in a recording mode and a reproduction mode. In the reproduction mode, it is possible to reproduce the recorded performance. FIG. 3 shows the detailed configuration of the controller 85.

In FIG. 3, the controller 85 operates under control of a one-chip micro computer (i.e., main micro computer) 91. Under control of this main micro computer 91, a micro computer 93 for controlling a floppy disk unit (i.e., local micro computer 93), a key-scanning micro computer 95 and a hammer-scanning micro computer 95*a* are operated.

The main micro computer 91 includes a central processing unit (CPU), a read-only memory (ROM), a random access memory (RAM), an electrically erasable programmable read-only memory (EEPROM) and a backup RAM, which construct the arithmetic logic unit (ALU). These portions are connected to an I/O portion via a common bus, so that data can be transmitted between these portions and external devices by this I/O portion.

The local micro computer 93 periodically scans operations of switches and the like provided at an operation panel 97. When any switch is operated during the scanning operation, this local micro computer 93 specifies the operated switch to thereby generate the corresponding code. In addition, by transmitting signals between the local micro computer 93 and a floppy disk driver 99, performance information is to be stored in a floppy disk 101 in the recording mode, or performance information is read from a floppy disk 101 in the reproduction mode.

In addition to the above-mentioned scanning operation and transmitting operation of the performance information, the local micro computer 93 can supply the performance information to an externally provided electronic musical instrument via a musical instrument digital interface I/O (i.e., MIDI I/O) 103. In addition to note-on, note-off information of MIDI and pedal-on, pedal-off information (i.e., pedal information), the performance information used in the present embodiment further includes string-striking information concerning the string-striking force.

On the other hand, the key-scanning micro computer 95 periodically scans states of the position sensors 89 corresponding to the keys 73 respectively in the recording mode, thereby detecting whether or not the shutter 87 is passed through the sensing points of each position sensor. When it is detected that the shutter 87 is passed through any one of the sensing points of the position sensor 89, the key-scanning micro computer 95 forms information concerning a key moving trace (hereinafter, simply referred to as key trace information).

The hammer-scanning micro computer 95 periodically scans states of the hammer sensors 89*a* corresponding to the shutters 75 of the hammer shanks respectively, thereby forming information concerning the striking speed of the hammer 75 (hereinafter, simply referred to as striking speed information).

Based on the key trace information, the main micro computer 91 forms information concerning key moving speeds in plural sections corresponding to time intervals by which the shutter 87 passes through plural sensing points of the position sensor 89. Then, the main micro computer 91 estimates the string-striking speed of the hammer by use of the above-mentioned information. Based on the estimated string striking speed, the main micro computer 91 forms string striking information. Thereafter, based on the key trace information, string-striking information and pedal operation information to be supplied from the pedal sensor 90 applied to the pedal mechanism, the main micro computer 91 forms the performance information, which is to be written in the floppy disk 101 under control of the local micro computer 93.

The above-mentioned operations are carried out in the recording mode. On the other hand, in the reproduction mode, the local micro computer 93 receives the performance information read from the floppy disk 101. Based on such performance information, the local micro computer 93 designates one of the solenoids 80, 83 to be excited by the solenoid driver 105. Then, based on the string-striking information contained in the performance information, the solenoid driver 105 varies the duty ratio of the pulse signal to be supplied to the designated one of the solenoids 80, 83.

Incidentally, in FIG. 3, 107 designates a power unit, and 109 designates a remote control switch unit.

(2) Operation of Embodiment

Next, description will be given with respect to the compensation process routine to be executed by the main micro computer 91 by referring to the flowchart shown in FIG. 4.

This compensation process can be activated when a test mode is set by operating the operation panel 97. The test program corresponding to this test mode can be carried out when the hammering operation control unit according to the present embodiment is built into the automatic performance piano and when the automatic performance piano is used.

In first step S1, the whole parts of the controller 85 are initialized. Herein, key numbers are respectively assigned to eighty-eight keys 73 in pitch-ascending or pitch-descending order. In step S2, the key-scanning micro computer 95 starts to scan the keys 73 from key No. 1. Then, the processing proceeds to step S3 wherein in order to strike the string of the key corresponding to the set key No., the solenoid driver 105 outputs the control signal to the corresponding solenoid 83. In this case, the current flown through the solenoid 83 is set identical to the constant reference value.

As a result, the key is rotatably moved about the balance pin 81 which is used as the fulcrum, so that the action mechanism 77 is driven. Therefore, the hammer 75 strikes the string at the specific string-striking speed which depends on the key to be operated. Herein, such specific string-striking speed is determined in response to the key-striking (or key-depressing) speed and dynamic characteristic with respect to each key. Herein, different string-striking speed depending on the lost motion and the like of the action mechanism 77 is assigned to each key.

In step S4, the motion of the key 73 or hammer 75 is detected by the corresponding position sensor 89 or hammer sensor **89*a*, from which the detection signal is supplied to the key-scanning micro computer 95 or hammer-scanning micro computer 95*a*. Herein, the position sensor 89 detects the key striking speed, while the hammer sensor 89*a*** detects the string-striking speed.

In step S5, the CPU reads the compensation value in the compensation data table from the EEPROM, wherein the compensation data table corresponds to the detected key No. based on the above-mentioned detection signal.

In step S6, the read compensation value is renewed by the deviation computed by the CPU. In step S7, the compensation data table is renewed based on the renewed compensation value. In other words, by carrying out the processes of steps S5 to S7, the preceding compensation value is corrected by use of the deviation which is computed based on the current detection signal. In the case where the first test program is carried out after assembling the present system, the predetermined data are written in the compensation data table.

Next, a key No. register (not shown) is incremented in step S8. In step S9, it is judged whether or not the incremented key No. reaches "89". In not, the processing returns to foregoing step S3, so that the set key No. is detected and the compensation value is renewed again. On the other hand, if the key No. reaches "89" indicating that the scanning is completed with respect to all keys, the processing proceeds to step S10.

In step S10, values of the renewed compensation data table are stored in EEPROM or backup RAM.

As described heretofore, the drive current is determined with respect to each solenoid 83 of each key 73 by executing the test program. Thereafter, in the case where the solenoid driver 105 drives the solenoid 83 under control of the main micro computer 91 in the reproduction mode, the drive current corresponding to the specific string-striking speed of each hammer 75 is supplied to the solenoid 83. As a result, it is possible to eliminate the disadvantages due to the variety of the string-striking forces or string-striking timings, resulting that the even tone-generation can be obtained when reproducing the musical performance.

(3) Modified Examples

Several modifications can be made based on the present embodiment.

(a) For example, it is possible to correct the compensation value and renew the compensation data table based on the average among plural string-striking speed data which are picked up by striking the key by plural times.

(b) It is possible to strike the key at plural stages of key-striking forces (i.e., plural stages of drive current levels).

(c) It is possible to provide two kinds of compensation data tables for first case where the key-striking force is relatively strong and second case where the key-striking force is relatively weak. Thus, the reproduction fidelity can be raised.

(d) It is possible to divide the key area of the keyboard into three key areas, e.g., lower-pitch key area, middle-pitch key area and higher-pitch key area. Then, three kinds of independent compensation data tables are provided with respect to three key areas respectively. For example, there can be four key areas, i.e., key area before white key, key area after white key, key area before black key, key area after black key.

(e) It is possible to further provide an error process to be executed by the main micro computer when the reproduction is carried out before executing the foregoing compensation process program or when the defective compensation value (i.e., defective compensation data table) is computed. In such error process, the error recovery can be made by use of the standard data table which is stored in advance.

As described heretofore, this invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. A hammering operation control unit of piano accompanied with automatic performance function comprising:

(a) key actuating means provided with respect to each of a plurality of keys of a keyboard of said piano for actuating each key;

(b) drive means for driving said key actuating means so that each key is driven by a reference drive value predetermined to each key;

(c) string-striking speed detecting means for detecting a string-striking speed of a hammer which strikes a string;

(d) compensation value computing means for computing a deviation of a detected string-striking speed from a target string-striking speed corresponding to said reference drive value as a compensation value;

(e) memory means for storing said compensation value by each key; and (f) renewing means for renewing storing contents of said memory means so that the newest compensation value computed by said compensation value computing means is to be stored in said memory means, whereby said string-striking speed and a dynamic characteristic of said hammer are compensated by said compensation value stored in said memory means.

2. A method of controlling a hammering operation of a piano comprising steps of:

detecting a string-striking speed of a hammer which is driven by a reference drive value predetermined to each key, computing a deviation of a detected string-striking speed from a target string-striking speed corresponding to said reference drive value as a compensation value, storing the newest compensation value, and compensating said string-striking speed of said hammer based on a stored compensation value with respect to each key.

* * * * *